US009029718B2

(12) United States Patent
Yang

(10) Patent No.: US 9,029,718 B2
(45) Date of Patent: May 12, 2015

(54) COMMON ACTUATOR SYSTEM OF MULTI SWITCHES FOR SWITCHGEAR

(71) Applicant: LSIS CO., LTD., Anyang-si, Gyeonggi-do (KR)

(72) Inventor: Jae Min Yang, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 222 days.

(21) Appl. No.: 13/779,656

(22) Filed: Feb. 27, 2013

(65) Prior Publication Data

US 2013/0228438 A1 Sep. 5, 2013

(30) Foreign Application Priority Data

Mar. 2, 2012 (KR) ..... 10-2012-0021952

(51) Int. Cl.

| | |
|---|---|
| ***H01H 13/72*** | (2006.01) |
| ***H01H 13/76*** | (2006.01) |
| ***H01H 3/58*** | (2006.01) |
| *H01H 3/26* | (2006.01) |

(52) U.S. Cl.

CPC ... *H01H 3/58* (2013.01); *H01H 3/26* (2013.01)

(58) Field of Classification Search

CPC ..... H01H 3/26; H01H 3/227; H01H 3/58; H01H 2003/326; H01H 31/10; H01H 3/3042; H01H 3/46; H01H 3/54; H01H 3/56

USPC ..... 200/5 A

See application file for complete search history.

(56) References Cited

U.S. PATENT DOCUMENTS

| | | | | |
|---|---|---|---|---|
| 5,652,416 | A * | 7/1997 | Sharaf et al. | 200/5 R |
| 7,026,558 | B1 * | 4/2006 | Andreyo | 200/17 R |
| 7,175,390 | B2 * | 2/2007 | Wobben | 416/61 |

(Continued)

FOREIGN PATENT DOCUMENTS

| | | |
|---|---|---|
| CN | 1513086 | 7/2004 |

(Continued)

OTHER PUBLICATIONS

Russian Federation Federal Service for Intellectual Property, Patents and Trademarks U.S. Appl. No. 2013109059/07, Notice of Allowance dated Sep. 2, 2014, 13 pages.

The State Intellectual Property Office of the People's Republic of China Application 201310065379.X, Office Action dated Oct. 20, 2014, 6 pages.

*Primary Examiner* — Kyung Lee

(74) *Attorney, Agent, or Firm* — Lee, Hong, Degerman, Kang & Waimey

(57) ABSTRACT

A common actuator system of multi switches for a switchgear is capable of selectively opening or closing the plurality of switches using a single common actuator motor. The actuator system includes a single actuator motor providing a rotational force for commonly opening or closing the plurality of switches and having an output shaft, a plurality of link members provided to correspond to the plurality of switches, respectively, to transfer the rotational force of the actuator motor to the plurality of switches, a selective power transfer mechanism to selectively connect one of the plurality of link members to the actuator motor, and a rotational-linear force conversion mechanism to convert the rotational force of one of the plurality of link members into a linear force for opening or closing a corresponding switch and providing the linear force to the switch.

12 Claims, 10 Drawing Sheets

(56) References Cited

U.S. PATENT DOCUMENTS

| | | | | |
|---|---|---|---|---|
| 7,227,091 | B2 * | 6/2007 | Gacond et al. | 200/17 R |
| 7,376,373 | B2 * | 5/2008 | Kim et al. | 399/228 |
| 7,697,862 | B2 * | 4/2010 | Kim et al. | 399/90 |
| 8,008,585 | B2 * | 8/2011 | Mills et al. | 200/50.32 |
| 2012/0168293 | A1 * | 7/2012 | Jung | 200/468 |
| 2013/0228438 | A1 * | 9/2013 | Yang | 200/5 A |

FOREIGN PATENT DOCUMENTS

| | | |
|---|---|---|
| CN | 1862737 | 11/2006 |
| CN | 201122522 | 9/2008 |
| CN | 102272876 | 12/2011 |
| EP | 1659601 | 5/2006 |
| JP | 2004-152689 | 5/2004 |
| WO | 2011/072541 | 6/2011 |

* cited by examiner

RELAED ART

COMMON ACTUATOR SYSTEM OF MULTI SWITCHES FOR SWITCHGEAR

CROSS-REFERENCE TO RELATED APPLICATIONS

Pursuant to 35 U.S.C. §119(a), this application claims the benefit of earlier filing date and right of priority to Korean Application No. 10-2012-0021952, filed on Mar. 2, 2012, the contents of which are hereby incorporated by reference herein in their entirety.

BACKGROUND OF THE INVENTION

1. Field of the Invention

This disclosure relates to a switchgear, and particularly, to a common actuator system of multi switches for a switchgear, capable of efficiently opening or closing a plurality of switches by connecting a motor as a single common driving source to selected one of the plurality of switches in a selective manner.

2. Background of the Invention

A switchgear which is a so-called load breaker switch, one of electric power receiving or distribution equipment, is an electric power receiving or distributing apparatus for dividing or diverging electric power circuits, which distributes received electric power to a plurality of electric load-side branch lines.

Such switchgears are classified into various types according to an insulating method, an installation position, a purpose of use, a voltage range and the like.

The switchgear includes a disconnecting switch and an earthing switch that are disposed for each of the plurality of electric power circuits. The disconnecting switch does not have a circuit breaking function which is carried out in response to detection of a fault current flowing on an electric power circuit, so the disconnecting switch is used for disconnecting or connecting the corresponding electric power circuit under a state of no electric load. And the earthing switch is used for discharging a remnant current remaining on a disconnected electric power circuit to the ground so as to protect an operator.

A single switchgear is configured with 6 switches including the disconnecting switch and the earthing switch, and more switches may further be installed in the switchgear according to consumers' demands.

Hereinafter, description will be given of one example of an actuator system of multi switches for a switchgear according to the related art with reference to FIG. 1.

As shown in FIG. 1, an actuator system of multi switches for a switchgear includes a plurality of actuators M1, M2, M3, . . . , Mn and a plurality of links L1, L2, L3, . . . , Ln connected to a plurality of switches SW1, SW2 SW3, . . . , SWn in one-to-one relationship. Here, the actuators M1, M2, M3, . . . , Mn may be configured by a motor.

According to the actuator system of the multi switches for the switchgear, driving forces of the plurality of actuators M1, M2, M3, . . . , Mn may be transferred to the plurality of switches SW1, SW2 SW3, . . . , SWn via the plurality of links L1, L2, L3, . . . , Ln, respectively, so as to open or close them.

With the configuration of the related art actuator system, the plurality of actuators M1, M2, M3, . . . , Mn and the plurality of links L1, L2, L3, . . . , Ln have the one-to-one relationship with the plurality of switches SW1, SW2 SW3, . . . , SWn. However, the plurality of switches SW1, SW2 SW3, . . . , SWn are not frequently opened or closed at ordinary times.

Hence, the low usage frequency of the plurality of switches SW1, SW2 SW3, . . . , SWn drops usage efficiencies of the plurality of actuators M1, M2, M3, . . . , Mn and the plurality of links L1, L2, L3, . . . , Ln. Further, the employment of the plurality of actuators M1, M2, M3, . . . , Mn and the plurality of links L1, L2, L3, . . . , Ln causes fabricating costs to excessively increase.

SUMMARY OF THE INVENTION

Therefore, an aspect of the detailed description is to provide a common actuator system of multi switches for a switchgear, capable of remarkably reducing fabricating costs by virtue of the use of a single actuator motor as a single common actuator.

To achieve these and other advantages and in accordance with the purpose of this disclosure, as embodied and broadly described herein, there is provided a common actuator system of multi switches for a switchgear, capable of switching the plurality of switches, the actuator system comprising:

a single actuator motor that provides a rotational force for commonly opening or closing the plurality of switches, the single actuator motor having an output shaft;

a plurality of link members that are disposed between the actuator motor and the plurality of switches and provided to correspond to the plurality of switches, respectively, the plurality of link members transferring the rotational force of the actuator motor to the plurality of switches; and a selective power transfer mechanism that operably connects one of the plurality of link members to the actuator motor in a selective manner so as to drive one of the plurality of switches to an opening position or a closing position.

In another preferred aspect of the present disclosure, the link member comprises a flexible shaft having flexibility.

In another preferred aspect of the present disclosure, each of the link members comprises a rotational-linear force conversion mechanism that converts the rotational force from the actuator motor into a linear force for opening or closing the corresponding switch and transfer the converted linear force to the corresponding switch.

In another preferred aspect of the present disclosure, the selective power transfer mechanism comprises:

a plurality of clutch assemblies that is provided to correspond to the plurality of switches, and linearly movable to a first position of transferring the rotational force of the actuator motor or a second position of stopping the transfer;

a cam that has a cam groove portion on an outer circumferential surface thereof, the cam groove portion commonly coupled to the clutch assemblies such that one of the plurality of clutch assemblies linearly moves to the first position or the second position, wherein the cam groove portion is formed by curved surfaces having a varying curvature; and a cam motor that rotates the cam.

In another preferred aspect of the present disclosure, the selective power transfer mechanism comprises:

a gear unit that has a main gear axially supported by the output shaft of the actuator motor to be rotatable in the same direction in response to rotation of the output shaft, a plurality of following gears rotatably coupled to the main gear as teeth thereof are engaged with teeth of the main gear and provided to correspond to the plurality of switches, respectively, and a plurality of power transfer pins disposed on each of the following gears to transfer the rotational force;

a plurality of clutch assemblies that is provided to correspond to the plurality of switches, respectively, each clutch assembly having a first position connected to the power transfer pins to receive the rotational force from the power transfer pins and a second position separated from the power transfer pins;

a cam that has a cam groove portion to which the plurality of clutch assemblies are commonly coupled, the cam groove portion being formed by channel walls facing each other and forming cam surfaces with a varying curvature, wherein the cam drives one of the plurality of clutch assemblies to the first position or the second position according to a position contacting each of the cam surfaces of the cam groove portion;

a cam motor that rotates the cam by a predetermined rotational angle to drive one of the plurality of clutch assemblies connected to the cam to the first position or the second position; and a plurality of rotational shafts that are coupled to the plurality of clutch assemblies, respectively, to be rotatable together with the clutch assemblies, the rotational shafts being connected to the corresponding link members to transfer the rotational force.

In another preferred aspect of the present disclosure, each of the clutch assemblies comprises:

a cam connecting member that is inserted into the cam groove portion of the cam to be movable back and forth along the cam groove portion of the cam;

a clutch plate member that has pin connection hole portions operably allowing the power transfer pins to insert into or separated from the power transfer pins;

a spring that is disposed between the clutch plate member and the cam connecting member, the spring pressing the clutch plate member toward the power transfer pins by applying elastic pressure to the clutch plate member when the cam connecting member moves toward the clutch plate member, and stopping to apply the elastic pressure to the clutch plate member when the cam connecting member moves away from the clutch plate member; and a connection pin that is inserted through the clutch plate member and the rotational shaft to connect the clutch plate member and the rotational shaft to each other.

In another preferred aspect of the present disclosure, the cam connecting member comprises a guide rod that extends therefrom in one direction to guide a linear motion in back and forth directions, wherein the actuator system further comprises a support plate having a through hole portion to guide the guide rod therethrough.

In accordance with another exemplary embodiment, there is provided a common actuator system of multi switches for a switchgear, capable of switching the plurality of switches, the actuator system comprising:

a single actuator motor that provides a rotational force for commonly opening or closing the plurality of switches, the single actuator motor having an output shaft;

a plurality of flexible shafts that are provided to correspond to the plurality of switches, respectively, and rotatably connected to the actuator motor to transfer the rotational force of the actuator motor, each flexible shaft having flexibility;

a selective power transfer mechanism that is disposed between the actuator motor and the plurality of flexible shafts to operably connect the actuator motor to the flexible shaft corresponding to one of the plurality of switches in a selective manner; and a rotational-linear force conversion mechanism that converts the rotational force from the actuator motor into a linear force for opening or closing the switches and transfer the converted linear force to the switches.

In another preferred aspect of the present disclosure, the actuator system may further comprise a gear unit that has a main gear axially coupled to the output shaft of the actuator motor to be rotatable in the same direction in response to a clockwise rotation or a counter clockwise rotation of the output shaft, a plurality of following gears rotatably coupled to the main gear as teeth thereof are engaged with teeth of the main gear and provided to correspond to the plurality of switches, respectively, and a plurality of power transfer pins provided to correspond to the plurality of following gears, respectively, to transfer the rotational force.

In another preferred aspect of the present disclosure, the selective power transfer mechanism comprises:

a plurality of clutches that are provided to correspond to the plurality of switches, respectively, and having a first position of being connected to the power transfer pins to receive the rotational force from the power transfer pins and a second position of being separated from the power transfer pins;

a cam that has a cam groove portion to which the plurality of clutch assemblies are commonly coupled, the cam groove portion being formed by channel walls facing each other and forming cam surfaces with a varying curvature, wherein the cam drives one of the plurality of clutches to the first position or the second position according to a position contacting each of the cam surfaces of the cam groove portion;

a cam motor that rotates the cam by a predetermined rotational angle to drive one of the plurality of clutches connected to the cam to the first position or the second position; and a plurality of rotational shafts that are coupled to the plurality of clutches, respectively, to be rotatable together with the clutches, the rotational shafts being connected to the corresponding flexible shafts.

In another preferred aspect of the present disclosure, the rotational-linear power transfer mechanism comprises:

a spiral worm that is rotatable by the rotational force from the selective power transfer mechanism;

a worm wheel that is rotatable as teeth thereof are engaged with the spiral worm;

is a worm wheel rotational shaft that is rotatable in response to rotation of the worm wheel;

a pinion gear that is disposed on the worm wheel rotational shaft coaxially with the worm wheel and rotatable in response to the rotation of the worm wheel; and a rack gear that is coupled to the pinion gear as teeth thereof are engaged with teeth of the pinion gear and linearly movable in response to the rotation of the pinion gear, the rack gear being movable to an opening position or a closing position of the switch by being coupled to a movable contactor of the switch.

In another preferred aspect of the present disclosure, the movable contactor of the switch comprises:

a conductive rod that has a long hole portion to limit a linear moving distance of the movable contactor and allow the worm wheel rotational shaft to be inserted therethrough, the conductive rod formed of an electrically conductive material with a long length, wherein the pinion gear and the rack gear are installed within the conductive rod.

In another preferred aspect of the present disclosure, the plurality of clutch assemblies are arranged to surround the main gear in a radial form based on an axial direction of the main gear.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

DETAILED DESCRIPTION OF THE INVENTION

Description will now be given in detail of configuration and operation of an actuator system of multi switches for a switchgear in accordance with the exemplary embodiments, with reference to the accompanying drawings. For the sake of brief description with reference to the drawings, the same or equivalent components will be having the same reference numbers, and description thereof will not be repeated.

Hereinafter, the configuration of a common actuator system (simply, actuator system) of multi switches for a switchgear will be described with reference to FIG. 2, which is a block diagram of a common actuator system of multi switches for a switchgear according to one exemplary embodiment of the present disclosure.

The common actuator system according to one exemplary embodiment of the present disclosure is employed to open or close a plurality of switches 50 included in a switchgear.

Figure 1:
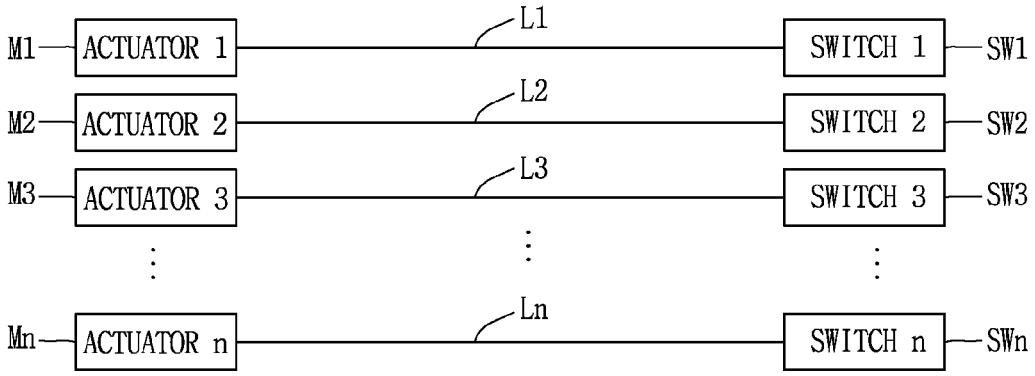
FIG. 1 is a block diagram showing a configuration of an actuator system of multi switches for a switchgear according to the related art.
Figure 2:
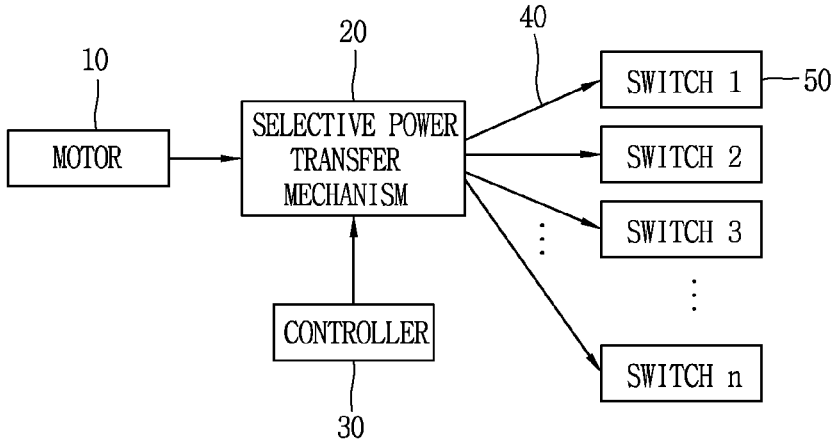
FIG. 2 is a block diagram briefly showing a configuration of a common actuator system of multi switches for a switchgear in accordance with an exemplary embodiment of the present disclosure.

Referring to FIG. 2, a common actuator system of a plurality of switches for a switchgear according to one exemplary embodiment of the present disclosure may include an actuator motor 10 as a drive, a selective power transfer mechanism 20 and a plurality of link members 40, except for the plurality of switches 50 which are the object to be actuated to be opened or closed.

In order to drive (manipulate, switch, move) one of the plurality of switches 50 to a circuit opening position (a so-called OFF-position) or a circuit closing position (a so-called ON position), the actuator system may further include a controller 30 for controlling the selective power transfer mechanism 20 to operably connect one of the plurality of link members 40 to the actuator motor 10 in a selective manner.

Figure 3:
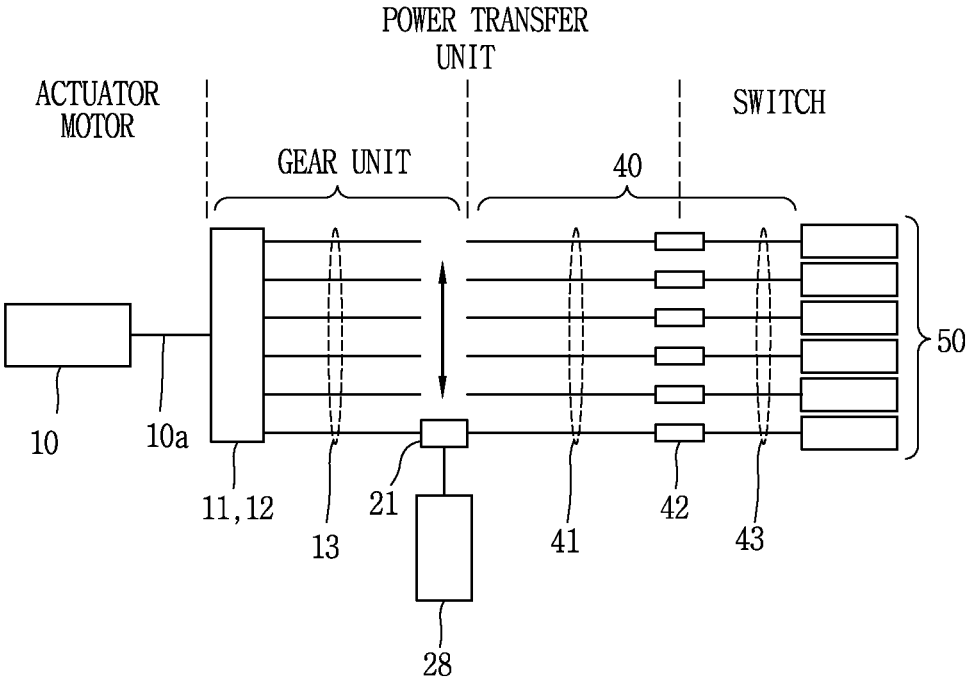
FIG. 3 is a detailed block diagram of the configuration shown in FIG. 2.
Figure 7:
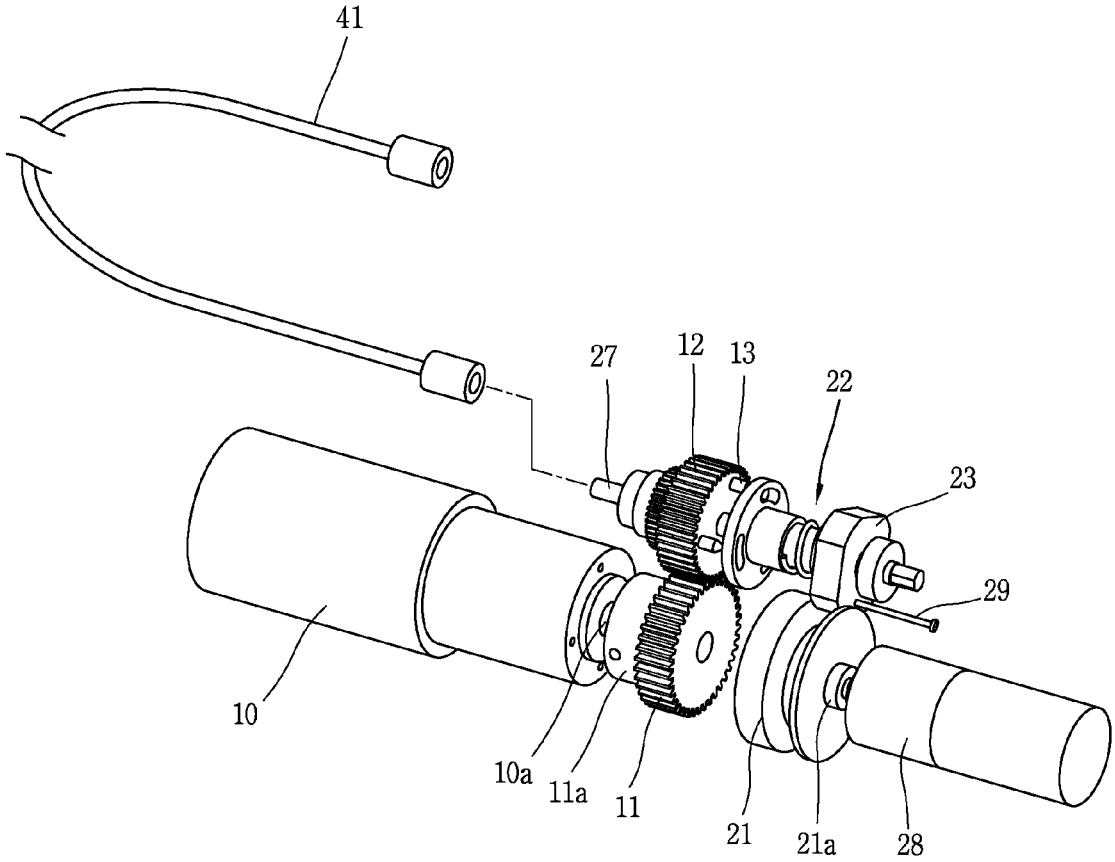
FIG. 7 is a view showing an actuator motor, a selective power transfer mechanism and a link member of the actuator system, which shows a separated state of a clutch and power transfer pins of the selective power transfer mechanism in the actuator system.

The actuator motor 10 is a single driving source which provides a rotational force for commonly switching opening or closing the plurality of switches 50. The actuator motor 10, as shown in FIG. 3 and FIG. 7, may include an output shaft 10*a*. Preferably, the actuator motor 10 may be configured by a driving motor, which is rotatable in a clockwise direction or a counterclockwise direction.

The selective power transfer mechanism 20 is a unit for selectively connecting one of the plurality of link members 40 to the actuator motor 10 such that one of the plurality of switches 50 can be driven to the opening position or the closing position.

The plurality of link members 40 may be connected between the actuator motor 10 as the single common driving source and the plurality of switches 50. The plurality of link members 40 may be provided to correspond to the plurality of switches 50, respectively, so as to transfer a rotational force of the actuator motor 10 to the plurality of switches 50.

Hereinafter, description will be given in more detail of the configuration of the actuator system of the plurality of switches for the switchgear, with reference to FIG. 3, which is a block diagram showing the configuration of the actuator system in detail more than in FIG. 2.

As shown in FIG. 3, the actuator system of the plurality of switches for the switchgear according to the one exemplary embodiment may roughly include the actuator driving source and a power transfer unit, except for the plurality of switches 50 which are the object to be actuated to be opened or closed.

The actuator driving source may include an actuator motor 10. The actuator motor 10 may provide a rotational force via an output shaft 10*a*.

The power transfer unit may include a gear unit, the plurality of link members 40, a cam 21, and a cam motor 28. Here, the cam 21 and the cam motor 28 are included in the selective power transfer mechanism 20.

Figure 6:
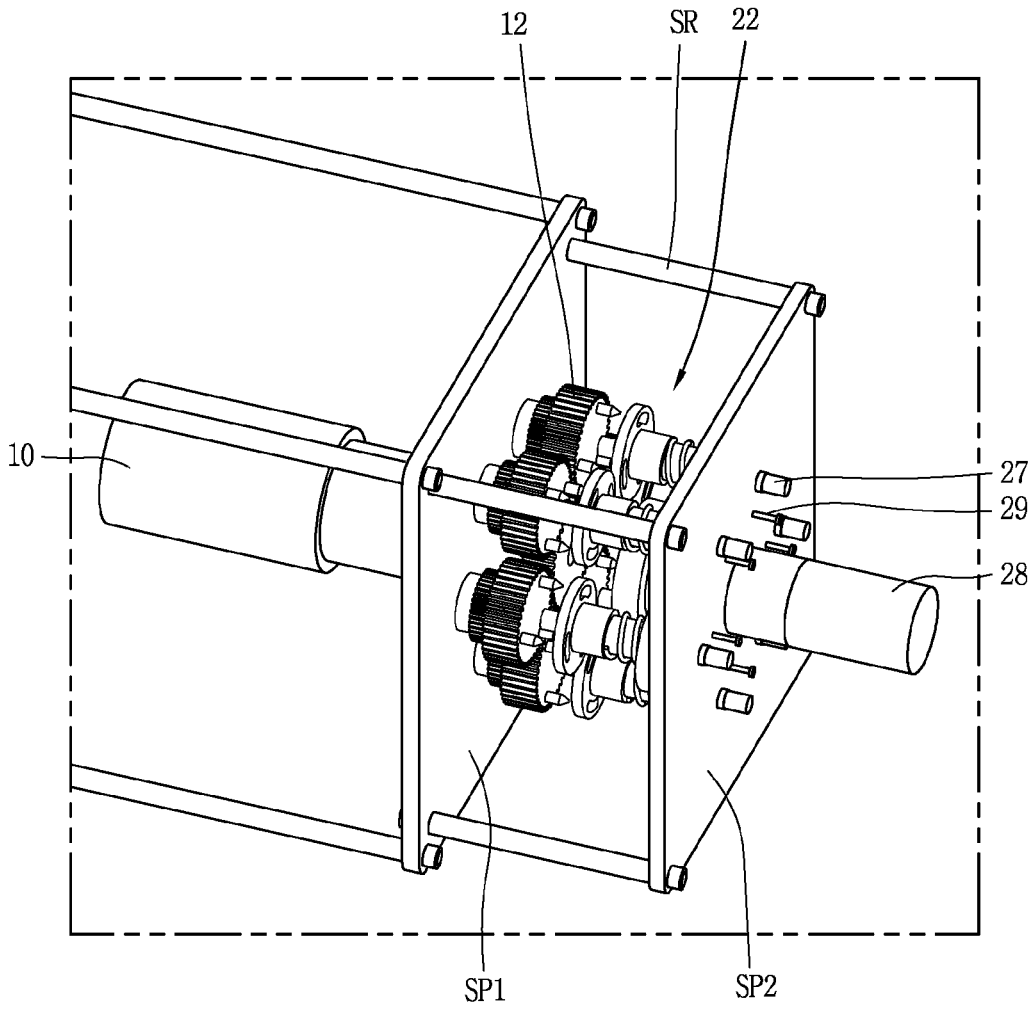
FIG. 6 is a perspective view showing mechanism configuration of an actuator system of multi switches for a switchgear in accordance with the preferred exemplary embodiment of the present disclosure.

The gear unit may include a single main gear 11, a plurality of following gears 12, and a plurality of power transfer pins 13 integrally formed with each of the following gears 12, as shown in FIGS. 6 and 7 which show a physical shape and a configuration of the gear unit.

The plurality of link members 40 may include a plurality of flexible shafts 41 (whose physical shape is shown in FIG. 7) and a plurality of rotational-linear force conversion mechanisms 42 all employed to correspond to the switches 50, respectively.

Figure 13:
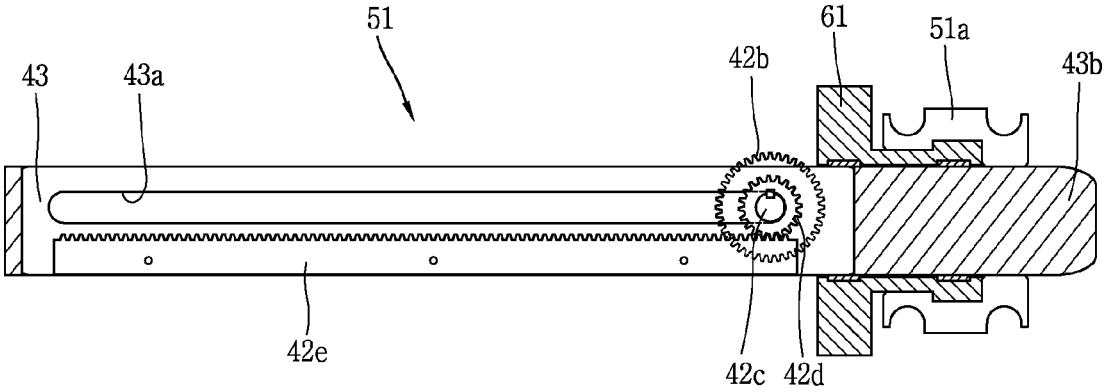
FIG. 13 is a longitudinal sectional view showing the configuration of the rotational-linear force conversion mechanism and the movable contactor of the switch in the actuator system.

The plurality of link members 40 may further include conductive rods 43 included in a movable contactor (see reference numeral 51 in FIG. 13).

The plurality of flexible shafts 41 may be disposed to correspond to the plurality of switches 50, respectively. The plurality of flexible shafts 41, which are flexible, may be rotatably connected to the actuator motor side, more particularly, a rotational shaft 27 (see FIGS. 7 and 8) of the selective power transfer mechanism 20, which will be explained later, so as to transfer the rotational force of the actuator motor 10. Here, the flexible shaft 41 is a component for transferring a mechanical force, and formed by winding a plurality of thin wires several times into a shape of coil to have flexibility, to transfer a mechanical force. The flexible shaft 41 is available by purchasing in the market.

Each rotational-linear force conversion mechanism 42 may convert the rotational force generated from the actuator motor 10 into a linear force for opening or closing the corresponding switch 50, and provide the converted linear force to the switch 50.

According to the exemplary embodiment shown in FIG. 3, the actuator system of the multi switches for the switchgear capable of opening or closing the multi switches 50 may include the one actuator motor 10 formed to provide a rotational force for commonly opening or closing the plurality of switches 50 and having the output shaft 10*a*, the plurality of flexible shafts 41 formed to correspond to the plurality of switches 50, respectively, rotatably connected to the side of the actuator motor 10 to transfer the rotational force of the actuator motor 10 and having flexibility, a selective power transfer mechanism 20 disposed between the actuator motor 10 and the plurality of flexible shafts 41 to operably connect the flexible shaft 41 corresponding to one of the plurality of switches 50 to the actuator motor 10 in a selective manner, and rotational-linear force conversion mechanism 42 to convert the rotational force transferred from the selective power transfer mechanism 20 into a linear force for opening or closing the corresponding switch 50 and transfer the converted linear force to the switch 50.

Figure 4:
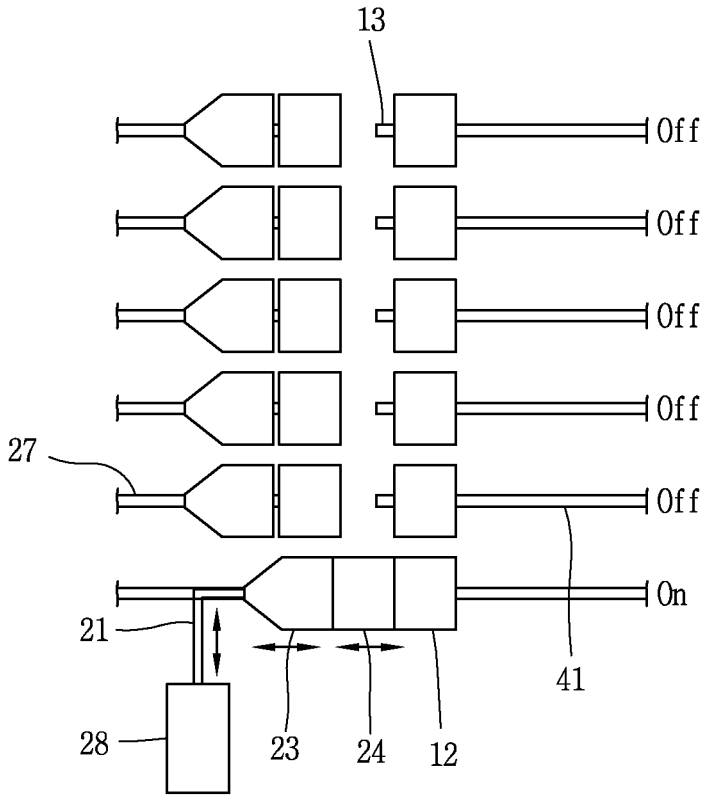
FIG. 4 is a view briefly showing a configuration and an operation status of a selective power transfer mechanism shown in FIG. 3.

In the meantime, as shown in FIG. 4, which is a block diagram briefly showing the selective power transfer mechanism included in the actuator system of the multi switches for the switchgear according to the exemplary embodiment, the selective power transfer mechanism 20 may include a plurality of clutches 24, a single common cam 21 and a single common cam motor 28.

The selective power transfer mechanism 20 may further include a plurality of cam connecting members 23, a plurality of following gears 12 and a plurality of rotational shafts 27.

Referring to FIG. 4, each following gear 12 may be provided with power transfer pins 13.

Still referring to FIG. 4, when the cam motor 28 rotates the cam 21 such that one cam connecting member 23 of the plurality of cam connecting members 23 is moved horizontally (FIG. 4 exemplarily shows a state that the lowermost cam connecting member is connected to the cam), the corresponding cam connecting member 23 may be horizontally moved to operably connect the power transfer pins 13 of the corresponding given gear 12 to the corresponding clutch 24. Accordingly, the rotational force of the actuator motor which is transferred via the rotational shaft 27 may be transferred to the switch 50 via the flexible shaft 41. Consequently, the corresponding switch 50 may be driven to the closing position (ON position) or the opening position (OFF position). Here, the power transfer pins 13 of the following gears 12, the clutches 24 and the switches 50, which correspond to the cam connecting members 23 without being horizontally moved by the cam 21, may remain at previous positions (i.e., in previous states of the ON or OFF positions).

Hereinafter, description will be given of an overall configuration of the actuator system of the multi switches for the switchgear and a controller for controlling the plurality of switches and the actuator system, with reference to FIG. 5.

Description will be briefly given of components further included in an exemplary embodiment of FIG. 5, in addition to the aforementioned elements for the actuator system described with reference to FIGS. 2 to 4.

Figure 5:
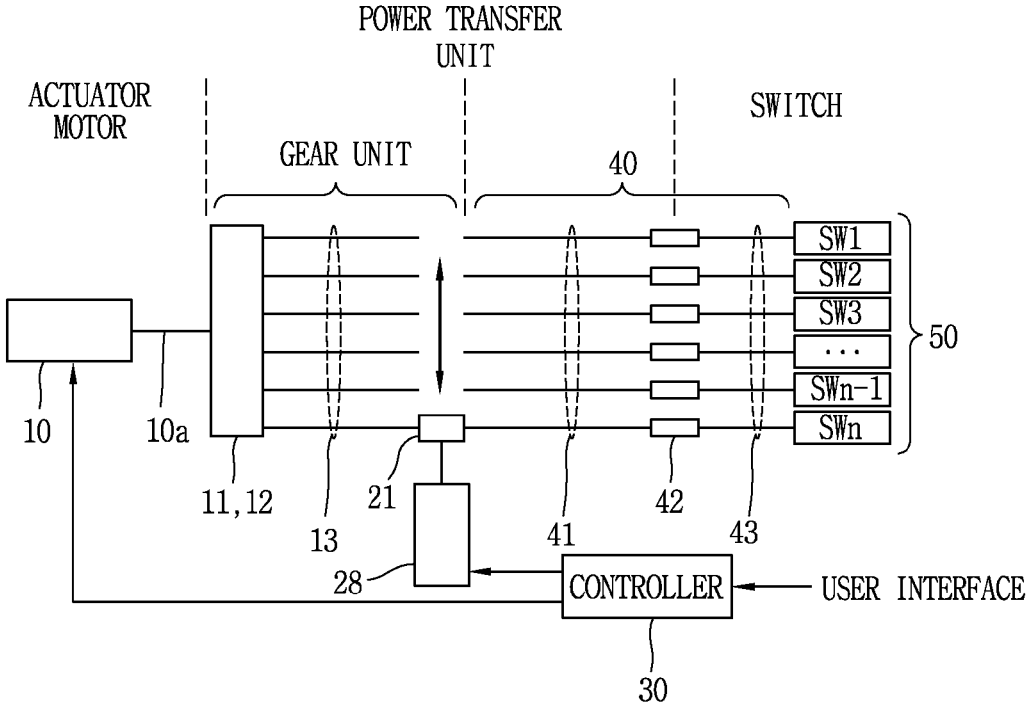
FIG. 5 is a view showing an overall configuration of the actuator system of the multi switches for the switchgear and a controller for controlling the plurality of switches and the actuator system.

The actuator system according to the exemplary embodiment of FIG. 5 may further include a controller 30, in addition to those elements given in the exemplary embodiment of FIG. 3.

The controller 30 may include a printed circuit board (PCB) having a microprocessor, and a user interface, such as a control panel, which is connected to the PCB. The controller 30 may read out information, input by a user, relating to a switch 50 to be driven to a closing position. The controller 30 may calculate a rotational angle to rotate the cam motor 28 in order to drive the corresponding switch 50 to the closing position, and rotate the cam motor 28 based on the calculated rotational angle. Also, in order to drive the switch 50 to the closing position, the microprocessor may send a driving control signal to the actuator motor 50 as well.

Operations of the other elements in FIG. 5 except for the controller 30 may be understood by the description of the exemplary embodiment of FIG. 3. Thus, detailed description thereof will be omitted.

Hereinafter, description will be given of a mechanical configuration and an operation of an actuator system of multi switches for a switchgear according to the present disclosure with reference to FIGS. 6 to 13.

Referring to FIG. 6, an actuator system of multi switches for a switchgear may include an actuator motor 10, a gear unit having following gears 12, clutch assemblies 22, and a cam motor 28.

SP1 in FIG. 6 designates a first support plate for supporting the gear unit. SP2 designates a second support plate for supporting the cam motor 28, a plurality of rotational shafts 27 and guide rods 29 to be explained later. Also, SR designates spacer bars for spacing the first support plate SP1 and the second support plate SP2 apart from each other to ensure a space for installing the gear unit and the clutch assemblies 22 between the first support plate SP1 and the second support plate SP2.

In FIG. 6, a single main gear may be included in the gear unit although it is invisible due to being obscured by the following gears 12. The following gears 12 may be disposed as many as the number of switches, as aforementioned. FIG. 6 exemplarily shows six following gears 12.

The clutch assemblies 22 may also be disposed as many as the number of switches, and FIG. 6 exemplarily shows six clutch assemblies.

The plurality of rotational shafts 27 and the guide rods 29 may also be disposed as many as the number of switches, and FIG. 6 exemplarily shows six rotational shafts and six guide rods, respectively.

Hereinafter, description will be given of configurations and operations of an actuator motor, a power transfer unit having a selective power transfer mechanism and a gear unit, and a flexible shaft in the actuator system, with reference to FIGS. 7 to 11.

Figure 8:
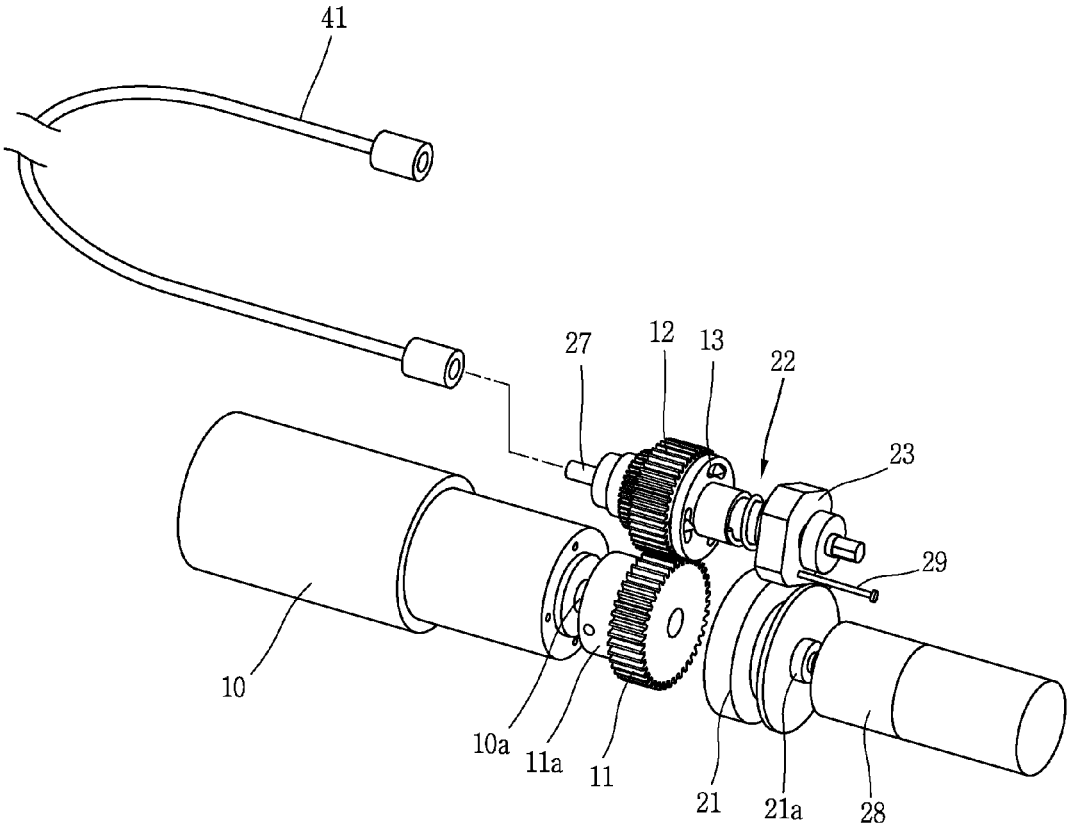
FIG. 8 is a view showing the actuator motor, the selective power transfer mechanism and the link member of the actuator system, which shows a connected state of the clutch and the power transfer pins of the selective power transfer mechanism in the actuator system.

Referring to FIGS. 7 and 8, the actuator system of multi switches for a switchgear in accordance with the preferred exemplary embodiment may include an actuator motor 10, a gear unit, a selective power transfer mechanism and a flexible shaft 41.

The actuator motor 10, as aforementioned, may be configured by a motor, which is rotatable in a clockwise or counterclockwise direction and controllable by the controller 30 of FIG. 5, and have an output shaft 10*a*.

Referring to FIGS. 7 and 8, the gear unit may include a single common main gear 11, a plurality of following gears 12 (FIG. 7 exemplarily shows a single following gear for the sake of explanation), and power transfer pins 13 integrally formed with the following gear 12.

The single main gear 11, as aforementioned, may be commonly provided for the power transfer unit and the plurality of switches to transfer a rotational force from the actuator motor 10 to the power transfer unit and the switches.

Still referring to FIGS. 7 and 8, the main gear 11 may include a shaft receiving portion 11*a* having a hollow tubular shape so as to be connected to the output shaft 10*a* of the actuator motor 10. The output shaft 10*a* and the shaft receiving portion 11*a* may be connected in a manner of inserting the output shaft 10*a* into the tubular shaft receiving portion 11*a* and then inserting a connection pin through the output shaft 10*a* and the shaft receiving portion 11*a*.

The main gear 11 may thusly be axially connected to the output shaft 10*a* of the actuator motor 10 so as to be rotatable in the same direction in response to rotation of the output shaft 10*a*.

The plurality of following gears 12 (FIGS. 7 and 8 exemplarily show one for the sake of explanation) may be connected as teeth thereof are engaged with teeth of the common main gear 11. The plurality of following gears 12 may be provided to correspond to the respective switches 50, and rotatable opposite to the rotating direction of the main gear 11 in response to the rotation of the main gear 11.

Each following gear 12 may include a plurality of power transfer pins 13 integrally extending from one side surface of the following gear 12. The preferred embodiment exemplarily shows three power transfer pins 13 formed on each following gear 12. The power transfer pins 13 may be formed on each following gear 12 to transfer a rotational force to the selective power transfer mechanism.

Figure 9:
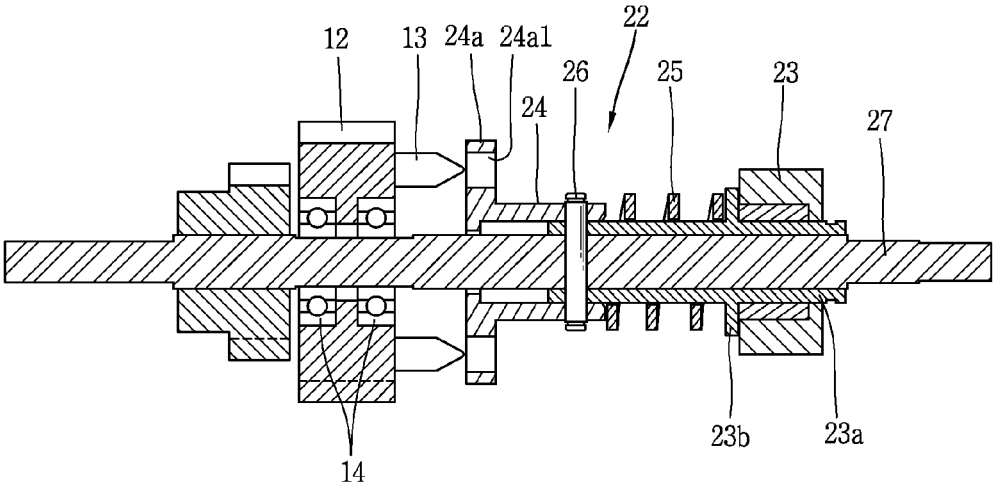
FIG. 9 is a longitudinal section view showing a clutch assembly, the power transfer pins and a rotational shaft of the actuator system in an operably separated state, which shows an operably separated state of the clutch and the power transfer pins of the selective power transfer mechanism in the actuator system.
Figure 10:
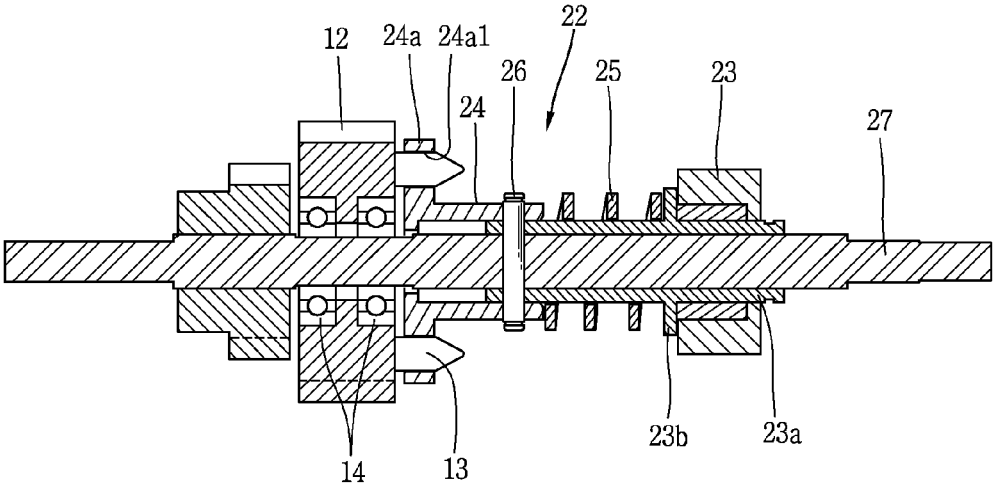
FIG. 10 is a longitudinal sectional view showing the clutch assembly, the power transfer pins and the rotational shaft of the actuator system in an operably connected state, which shows an operably connected state of the clutch and the power transfer pins of the selective power transfer mechanism in the actuator system.

FIGS. 7 and 8 show that the rotational shaft 27 is installed to be directly connected to the following gears 12. Actually, the rotational shaft 27, as shown in FIGS. 9 and 10, may be connected to the following gear 12 with a bearing 14 interposed therebetween. Therefore, the rotational shaft 27 may not rotate even if the following gear 12 rotates.

Referring back to FIGS. 7 and 8, the selective power transfer mechanism may include a plurality of clutch assemblies 22 (FIGS. 7 and 8 merely show one for the sake of explanation), namely, clutches 24 (see FIG. 9), a cam 21 and a cam motor 28.

The plurality of clutch assemblies 22, namely, the clutches 24 may be disposed to correspond to the number of the plurality of switches 50 (see FIG. 2), and linearly movable between a first position for transferring the rotational force from the actuator motor 10 and a second position for stopping the transfer.

In more detail, the plurality of clutch assemblies 22, namely, the clutches 24 may be units disposed in correspondence with the switches 50 (see FIGS. 2, 3 and 5), respectively. Referring to FIGS. 7 and 8, each clutch assembly 22 may have a first position where it is connected to the power transfer pins 13, receives the rotational force via the power transfer pins 13, and transfers it to the rotational shaft 27, and a second position where it is separated from the power transfer pins 13 to stop the transfer of the rotational force to the rotational shaft 27.

According to the preferred embodiment of the present disclosure, as shown in FIG. 6 or 7, the plurality of clutch assemblies 22 may be disposed to surround the main gear 11 in a radial form based on an axial direction of the main gear 11. This may result in simplifying a mechanical design as much as possible, and reducing the size of the actuator system capable of opening or closing the plurality of switches.

In FIGS. 7 and 8, the cam 21 may be commonly connected to the plurality of clutch assembly 22, namely, the clutches 24 (see FIG. 9), to linearly move one of the plurality of clutch assemblies 22, namely, the clutches 24 to the first position or the second position.

Figure 11:
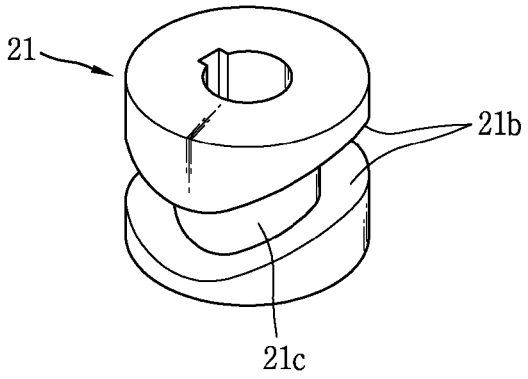
FIG. 11 is a perspective view of a cam in the actuator system.

Referring to FIG. 11, the cam 21 may include a cam groove portion 21*c* on its outer circumferential surface. The cam groove portion 21*c* may be formed by channel wall surfaces 21*b* with varying curvature.

In other words, referring to FIG. 7, 8 or 11, the cam 21 may include the cam groove portion 21*c* to which the plurality of clutch assemblies 22 are commonly coupled. Channel walls 21*b* which face each other to form the cam groove portion 21*c* may be formed as cam surfaces whose curvature vary. Accordingly, the cam 21 may move one of the plurality of clutch assemblies 22 to the first position or the second position according to a position on which the one clutch assembly 22, namely, the one clutch 24 contacts each of the cam surfaces of the cam groove portion 21*c*.

Hence, after being coupled to the cam groove portion 21*c* of the cam 21, the clutch assembly 22, namely, the clutch 24 may linearly move forwardly or backwardly in response to the rotation of the cam 21.

The cam motor 28 may be configured by a motor which provides a force for rotating the cam 21 and is rotatable in clockwise direction or counter clockwise direction. In other words, the cam motor 28 may rotate the cam 21 by a predetermined rotational angle so as to drive a selected one of the clutch assemblies 22 coupled to the cam 21 to the first position or the second position.

The cam motor 28 may have an output shaft (not shown), and the cam 21 may include a shaft receiving portion 21*a* for connection with the output shaft of the cam motor 28. The connection between the output shaft and the shaft receiving portion 21*a* may be allowed as the output shaft of the cam motor 28 is inserted into the tubular shaft receiving portion 21*a* and a connection pin (not shown) is inserted through the output shaft and the shaft receiving portion 21*a*.

Referring to FIGS. 7 and 8, the selective power transfer mechanism may further include the rotational shaft 27.

The rotational shaft 27 may be connected to the clutch assembly 22 to rotate together with the clutch assembly 22, and is an element for transferring the rotational force to the link member (or the flexible shaft 41 in the embodiment shown in FIGS. 7 and 8).

Hereinafter, a detailed configuration of the clutch assembly 22 will be described with reference to FIGS. 9 and 10.

The clutch assembly 22 may include a cam connecting member 23, a clutch plate member 24*a*, a spring 25 and a connection pin 26.

The cam connecting member 23 is a member which is inserted into the cam groove portion 21*c* (see FIG. 11) of the cam 21 to be movable back and forth along the cam groove portion 21*c* of the cam 21.

The cam connecting member 23 may include a cam connecting portion (reference numeral not given) protruding to be inserted into the cam groove portion 21*c* of the cam 21, a shaft receiving portion 23*a* integrally extending long from the cam connecting portion and receiving the rotational shaft 27 inserted therethrough, and a spring seat portion 23*b* extending from the shaft receiving portion 23*a* in a radial direction for supporting one end of the spring 25.

The cam connecting member 23 may include a guide rod 29 (see FIGS. 7 and 8) extending in one direction to linearly guide its forward or backward movement. The actuator system of the multi switches for the switchgear may further include a second support plate SP2 having a through hole portion for guiding the guide rod 29 therethrough.

The clutch plate member 24*a* may include a plurality of pin connection hole portions 24*a*1 that allow inserting of the power transfer pins 13 or separating of the power transfer pins 13 from.

The spring 25 may be installed between the clutch plate member 24*a* and the cam connecting member 23. In more detail, the spring 25 may be disposed between the clutch plate member 24*a* and the spring seat portion 23*b* of the cam connecting member 23, such that one end can be supported by the spring seat portion 23*b* and the other end can be supported by the clutch plate member 24*a*.

When the cam connecting member 23 is moved toward the clutch plate member 24*a*, the spring 25 may be pressed by the spring seat portion 23*b* of the cam connecting member 23 to transfer elastic pressure to the clutch plate member 24*a*. Accordingly, the clutch plate member 24*a* may be pressed toward the power transfer pins 13.

When the cam connecting member 23 is moved away from the clutch plate member 24*a*, the pressure applied by the spring seat portion 23*b* of the cam connecting member 23 may disappear. The spring 25 may thus stop to transfer the elastic pressure to the clutch plate member 24*a*.

The connection pin 26 is a pin which is inserted through the clutch plate member 24*a* or the clutch 24 and the rotational shaft 27 for connecting the clutch 24 or the clutch plate member 24*a* to the rotational shaft 27.

Referring to FIGS. 9 and 10, since the bearing 14 is interposed between the following gear 12 and the rotational shaft 27, the rotational shaft 27 may not rotate even if the following gear 12 rotates.

Only when one clutch plate member 24*a* is connected to the corresponding power transfer pins 13 as shown in FIG. 10, the rotation of the following gear 12 may be transferred to the corresponding rotational shaft 27. Consequently, the rotational shaft 27 may rotate responsively.

When the power transfer pins 13 are separated from the clutch plate member 24*a* as shown in FIG. 9, the following gear 12 makes an idle rotation and the rotational shaft 27 is stopped.

Hereinafter, description will be given of a detailed configuration of the rotational-linear force conversion mechanism 42 (see FIGS. 3 and 5) which may be included in the actuator system of the multi switches for the switchgear, with reference to FIGS. 12 and 13.

The rotational-linear force conversion mechanism 42 may include a spiral worm 42*a*, a worm wheel 42*b*, a worm wheel rotational shaft 42*c*, a pinion gear 42*d* and a rack gear 42*e*.

Figure 12:
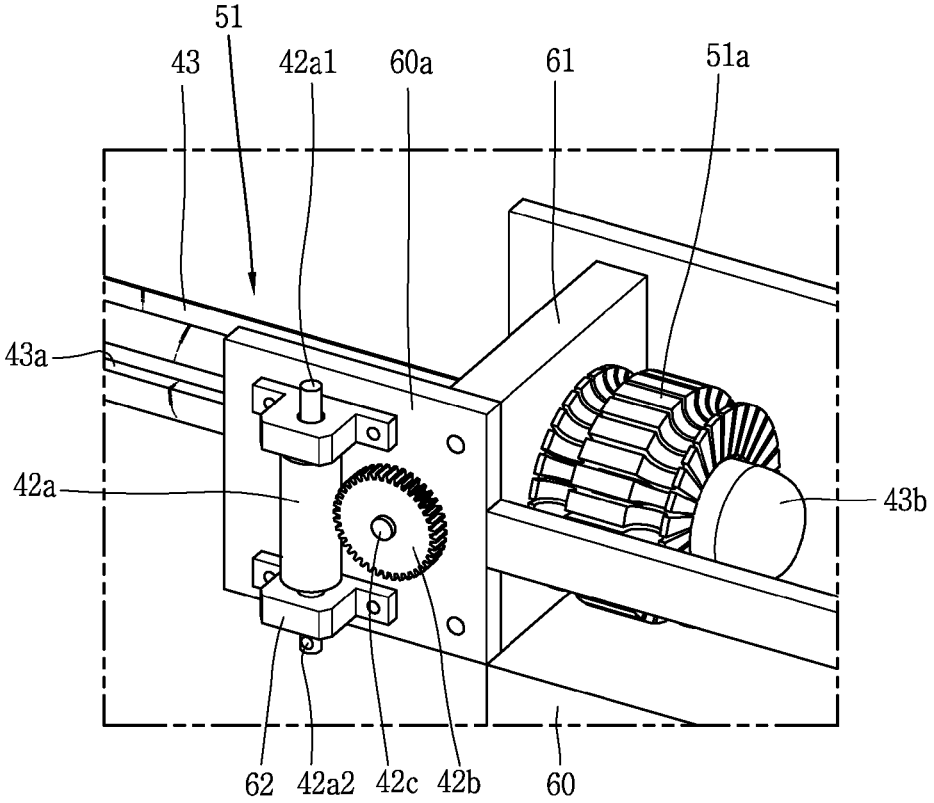
FIG. 12 is a perspective view partially showing appearance of a rotational-linear force conversion mechanism connected to the link member and a movable contactor of a switch in the actuator system.

In FIG. 12, the reference numeral 42*a*1 designates a free end of a shaft for supporting the spiral worm 42*a*, and 42*a*2 designates a connecting end of the shaft for supporting the spiral worm 42*a*. The flexible shaft 41 may be connected to the connecting end of the shaft.

Also, the reference numeral 62 designates a pair of support brackets for supporting upper and lower portions of the shaft which supports the spiral worm 42*a*, and 60*a* designates a support side plate for supporting the spiral worm 42*a*, the worm wheel 42*b* and the support brackets 62.

In FIG. 12, the reference numeral 61 designates a support plate which supports a conductive rod 43 and is formed of a conductor which is electrically connectable with an electric power circuit of an external electric power source side or an electric load side. The support plate 61 may include a tubular extending portion extending from a plate surface of the support plate 61.

The reference numeral 60 designates a supporting base, and 51 designates a movable contactor of each switch 50.

The reference numeral 51*a* designates a plurality of finger contactors, which are fixed in an annular shape on the tubular extending portion of the support plate 61 along a circumferential direction and electrically connected to the conductive rod 43 by contacting an outer circumferential surface of the conductive rod 51 of the movable contactor 51.

The reference numeral 43 designates the conductive rod forming a body part of the movable contactor 51, 43*a* designates a long hole portion of the conductive rod 43, and 43*b* designates a front end portion of the movable contactor 51.

The one exemplary embodiment of the present disclosure illustrates that the conductive rod 43 of the movable contactor 51 is electrically connected to the external electric power source side or the electric load side power circuit via the plurality of finger contactors 51*a* and the support plate 61. According to another embodiment, a flexible wire made of copper may be connected to a rear end of the conductive rod 43 so as to be electrically connected to the external electric power source side or electric load side power circuit through the flexible wire.

The spiral worm 42*a* is a pillar which is rotated by the rotational force transferred from the selective power transfer mechanism 20 via the flexible shaft 41, and whose external circumferential surface is formed as a threaded surface.

The worm wheel 42*b* is a wheel having teeth on its outer circumferential surface, and may be rotatable as the teeth are engaged with the spiral worm 42*a*.

The worm wheel rotational shaft 42*c* may be inserted through the worm wheel 42*b* so as to rotate in the same direction in response to rotation of the worm wheel 42*b*.

Referring to FIG. 13, the pinion gear 42*d* may be disposed within the conductive rod 43 and connected to the worm wheel rotational shaft 42*c* coaxially with the worm wheel 42*b* so as to be rotatable in response to the rotation of the worm wheel 42*b*.

The rack gear 42*e* may be installed to be coupled to the conductive rod 43 of the movable contactor 51 by a coupling member, such as a fixing screw, within the conductive rod 43 of the movable contactor 51. The rack gear 42*e* may be connected to the pinion gear 42*d* as their teeth are engaged with each other, and linearly movable in response to the rotation of the pinion gear 42*d*.

Hence, the rack gear 42*e* may be moved to opening or closing position with being coupled to the movable contactor 51 of the switch 50.

Still referring to FIG. 13, the movable contactor 51 of the switch 50 may include the conductive rod 43. The conductive rod 43 may include a long hole portion 43*a* which limits a linear moving distance of the movable contactor 51 and allows the worm wheel rotational shaft 42*c* to be inserted therethrough. The conductive rod 43 may be formed of an electrically conductive material with a long length and include the front end portion 43*b* having a front surface processed to be round for electric connection to a corresponding stationary contactor (not shown) of the switch 50.

Although not shown, the stationary contactor (not shown) electrically connected to the front end portion 43*b* of the conductive rod 43 may be configured by installing a plurality of finger contactors using a ring-shaped spring on an outer circumferential surface of an end portion of a conductive busbar in a circumferential direction. As the outer circumferential surface of the front end portion 43*b* of the conductive rod 43 of the movable contactor 51 contacts an inner circumferential surface of the plurality of finger contactors of the corresponding stationary contactor, the electric power circuit may be closed. Also, as the outer circumferential surface of the front end portion 43*b* of the conductive rod 43 of the movable contactor 51 is separated from the inner circumferential surface of the plurality of finger contactors of the corresponding stationary contactor, the electric power circuit may be open.

Hereinafter, description will be given of an operation of an actuator system of multi switches for a switchgear according to the preferred embodiment, with the accompanying drawings.

For example, when a user inputs a request, via a user interface such as a push button, to drive a predetermined switch of the plurality of switches 50 to a closing position, the controller 30 shown in FIG. 5 may read out information relating to the switch 50 that the user desires to drive to the closing position. Then, the controller 30 may calculate a rotational angle for rotating the cam motor 28 in order to drive the corresponding switch 50 to the closing position, and control the cam motor 28 to rotate based on the calculated rotational angle.

Also, to drive the switch 50 to the closing position, the controller 30 may also send a driving control signal, which instructs, for example a counterclockwise rotation to the actuator motor 10.

In order to drive the switch 50 to an opening position, the controller 30 may send a driving control signal, which instructs, for example a clockwise rotation to the actuator motor 10.

In response to the counterclockwise rotation of the actuator motor 10, as shown in FIG. 7, the main gear 11 connected to the output shaft 10*a* of the actuator motor 10 may rotate in the counterclockwise direction, and the plurality of following gears 12 whose teeth are engaged with teeth of the main gear 11 may rotate in the clockwise direction.

When the controller 30 drives the cam motor 28 to rotate by the calculated rotational angle for driving the predetermined switch 50 to the closing position, one of the plurality of cam connecting members 23 corresponding to the predetermined switch 50 may move forward along the cam groove portion 21*c* of the cam 21.

As the cam connecting member 23 moves forward from the state shown in FIG. 9, the spring 25 may be pressed by the spring seat portion2 3*b* of the cam connecting member 23 to transfer elastic pressure to the clutch plate member 24*a*. The clutch plate member 24*a* may thusly be pressed toward the power transfer pins 13.

The power transfer pins 13 of the following gear 12 may then be inserted into the pin connection hole portions 24*a*1 of the clutch plate member 24*a*, and accordingly the rotational force may be transferred from the following gear 12 to the clutch plate member 24*a*. Hence, the rotational shaft 27, which is connected to the clutch plate member 24*a* (namely, the clutch 24) by the connection pin 26, may rotate in the same direction as the following gear 12.

The rotation of the rotational shaft 27, as shown in FIGS. 7 and 8, may be performed such that one end of the rotational shaft 27 rotates in the same direction as the flexible shaft 41 which is a link member connected to the rotational shaft 27.

In response to the rotation of the flexible shaft 41, as shown in FIG. 12, the spiral worm 42*a* connected to the other end of the flexible shaft 41 may rotate in the same direction (for example clockwise direction) by virtue of the connecting end 42*a*2 of the shaft for supporting the spiral worm 42*a*.

Referring to FIG. 13, the pinion gear 42*d*, which is connected to the worm wheel rotational shaft 42*c* coaxially with the spiral worm 42*a*, may rotate in the counterclockwise direction.

As the pinion gear 42*d* rotates in the counterclockwise direction, the rack gear 42*e* whose teeth are engaged with the teeth of the pinion gear 42*d* may linearly move to the right in FIG. 13. Hence, the conductive rod 43 of the movable contactor 51 coupled to the rack gear 42*e* may linearly move to the right.

The front end portion 43*b* of the conductive rod 43 which linearly moves to the right may contact a corresponding stationary contactor (not shown). Consequently, the electric power source side or the electric load side electric power circuit connected to the movable contactor 51 and a corresponding electric load side or electric power source side electric power circuit connected to the stationary contactor are in a closed state (i.e., closing position).

An operation of opening the switch 50 may be performed in the same manner except for the operational direction. Therefore, detailed description thereof will be omitted.

As described above, a common actuator system of multi switches for a switchgear capable of opening or closing the plurality of switches according to the present disclosure may have the configuration that a driving force for the plurality of switches can be generated by a single common actuator motor and one selected from the plurality of switches can be opened or closed by selectively connecting one of a plurality of link members to the common actuator motor. This may allow for implementing an actuator system of switches for a switchgear having remarkably reduced fabricating costs and highly improved usage efficiency of the actuator motor, as compared with the related art having the actuator motors as many as the number of switches.

In the common actuator system of the multi switches for the switchgear according to the present disclosure, the link member may include a flexible shaft which is flexible. Therefore, the actuator motor, namely, the driving unit, and the switches may be freely disposed, such as, longitudinally, horizontally, perpendicularly, and the like. This may allow the arrangement and configuration of the switchgear to be also freely configured by a longitudinal type, a horizontal type, a perpendicular type and the like.

In the common actuator system of the multi switches for the switchgear according to the present disclosure, the link member may include a rotational-linear force conversion mechanism for converting the rotational force of the actuator motor into a linear force to transfer to the switch. Accordingly, the rotational force of the motor may be converted into the linear force so as to be used to open or close the corresponding switch.

In the common actuator system of the multi switches for the switchgear according to the present disclosure, the actuator system may further include a selective power transfer mechanism. The selective power transfer mechanism may include a plurality of clutches disposed to correspond to the plurality of switches and linearly movable to a first position for transferring the rotational force from the actuator motor and a second position for stopping the transfer, a cam having a cam groove portion formed on an outer circumferential surface thereof, the cam groove portion having a varying radius of curvature and being commonly connected to the plurality of clutches such that one of the plurality of clutches can linearly move to the first position or the second position, and a cam motor for rotating the cam. With the configuration, the rotational force may be transferred from the actuator motor to a switch selected from the plurality of switches based on a rotational angle of the cam motor so as to drive the switch to an opening or closing position.

In the common actuator system of the multi switches for the switchgear according to the present disclosure, the selective power transfer mechanism may include a gear unit having a plurality of power transfer pins, a plurality of clutch assemblies movable to a first position of being connected to the power transfer pins and a second position of being separated from the power transfer pins, a cam for driving the clutch assemblies to the first position or the second position, and a rotational shaft rotatable with the cam motor for rotating the cam and the clutch assemblies and connected to transfer the rotational force to the link member. With the configuration, as one clutch assembly is selectively connected to the power transfer pins based on the rotational angle of the cam driven by the cam motor, a switch corresponding to the one clutch assembly may selectively be driven to the opening position or the closing position.

In the common actuator system of the multi switches for the switchgear according to the present disclosure, each clutch assembly may include a cam connecting member inserted into the cam groove portion of the cam to be movable back and forth along the cam groove portion of the cam, a clutch plate member having pin connection hole portions operably connected to the power transfer pins inserted thereinto or separated from the power transfer pins, a spring installed between the clutch plate member and the cam connecting member to transfer elastic pressure to the clutch plate member when the cam connecting member moves toward the clutch plate member, such that the clutch plate member can be pressed toward the power transfer pins, and stop the transfer of the elastic pressure to the clutch plate member when the cam connecting member moves away from the clutch plate member, and a connection pin inserted through the clutch plate member and the rotational shaft to connect the clutch plate member and the rotational shaft to each other. With the configuration, the cam connecting member inserted into the cam groove portion of the cam may move forward or backward in response to the rotation of the cam, and accordingly the clutch plate member may move forward or backward in response to elastic pressing or releasing of the spring installed between the cam connecting member and the clutch plate member. When the clutch plate member moves forward, the clutch plate member may be connected to the power transfer pins and the rotational shaft connected to the clutch plate member by the connection pin may thusly rotate so as to transfer the rotational force of the actuator motor to a switch. When the clutch plate member moves backward, the clutch plate member may be separated from the power transfer pins. Accordingly, the rotational shaft connected to the clutch plate member by the connection pin may not rotate any more, thereby stopping to transfer the rotational force of the actuator motor to the switch.

In the common actuator system of the multi switches for the switchgear according to the present disclosure, the cam connecting member may include a guide rod extending in one direction, and may further include a support plate having a through hole portion through which the guide rod is guided. This may linearly guide the forward or backward motion of the cam connecting member.

The common actuator system of the multi switches for the switchgear according to the present disclosure may further include a main gear axially connected to the output shaft of the actuator motor to be rotatable in the same direction in response to a forward or backward rotation of the output shaft, a plurality of following gears rotatably coupled to the main gear in a manner of teeth engagement and formed to correspond to each of the switches, and a gear unit having a plurality of power transfer pins disposed on each of the following gears to transfer a rotational force. With the configuration, the plurality of following gears corresponding to the plurality of switches, respectively, may be driven by one main gear as a common driving force, thereby opening or closing the plurality of switches.

In the common actuator system of the multi switches for the switchgear according to the present disclosure, the rotational-linear force conversion mechanism may include a spiral worm rotatable by the rotational force transferred from the selective power transfer mechanism, a worm wheel rotatable with teeth thereof being engaged with teeth of the spiral worm, a worm wheel rotational shaft rotatable in response to the rotation of the worm wheel, a pinion gear coaxially connected to the worm wheel rotational shaft to be rotatable responsive to the rotation of the worm wheel, and a rack gear connected to the pinion gear in a manner of teeth engagement to be linearly movable responsive to the rotation of the pinion gear and movable to the opening position or the closing position with being coupled to a movable contactor of the switch. With the configuration, when the spiral worm is rotated by the rotational force transferred from the selective power transfer mechanism, the worm wheel whose teeth are engaged with those of the spiral worm may rotate and accordingly the pinion gear coaxially connected to the worm wheel via the worm wheel rotational shaft may rotate. In response to the rotation of the pinion gear, the rack gear may linearly move such that a movable contactor coupled to the rack gear can be driven to the closing position to contact the stationary contactor or the opening position to be separated from the stationary contactor.

In the common actuator system of the multi switches for the switchgear according to the present disclosure, the movable contactor of the switch may include a long hole portion to limit the linear moving distance of the movable contactor and allow the worm wheel rotational shaft to be inserted therethrough, and a conductive rod formed of an electrically conductive material with a long length. The pinion gear and the rack gear may be installed within the conductive rod. Accordingly, the linear motions of the rack gear and the movable contactor for switching the switch to the closing position may be executed by the rotation of the pinion gear in response to the rotation of the worm wheel. Also, the moving distance of the movable contactor for switching the switch to the opening position or the closing position may be decided by the limit of the linear moving distance of the movable contactor by the long hole portion of the conductive rod of the movable contactor.

In the common actuator system of the multi switches for the switchgear according to the present disclosure, the plurality of clutch assemblies may be arranged to radially surround the main gear in an axial direction of the main gear. This may simplify the mechanical design as much as possible, and the actuator system of the multi switches for the switchgear may be reduced in size.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A common actuator system capable of switching a plurality of switches for a switchgear, the actuator system comprising:

a single actuator motor configured to provide a rotational force for opening or closing the plurality of switches, the single actuator motor comprising an output shaft;

a plurality of link members disposed between the actuator motor and the plurality of switches and corresponding to the plurality of switches, the plurality of link members configured to transfer the rotational force of the actuator motor to the plurality of switches;

a selective power transfer mechanism configured to operably couple one of the plurality of link members to the actuator motor in a selective manner so as to drive one of the plurality of switches to an opening position or a closing position, the selective power transfer mechanism comprising:

a plurality of clutch assemblies corresponding to the plurality of switches and linearly moveable to a first position for transferring the rotational force of the actuator motor or a second position for stopping the transfer of the rotational force of the actuator motor;

a cam comprising a cam groove portion on an outer circumferential surface, the cam groove portion formed by curved surfaces having a varying curvature and configured to be commonly coupled to the plurality of clutch assemblies such that one of the plurality of clutch assemblies is linearly moved to the first position or the second position; and a cam motor configured to rotate the cam.

2. The actuator system of claim 1, wherein each of the plurality of link members comprise a flexible shaft.

3. The actuator system of claim 1, wherein each of the plurality of link members comprise a rotational-linear force conversion mechanism configured to convert the rotational force from the actuator motor into a linear force for opening or closing the corresponding switch and to transfer the converted linear force to the corresponding switch.

4. The actuator system of claim 3, wherein the rotational-linear power transfer mechanism comprises:

a spiral worm that is rotatable by the rotational force from the selective power transfer mechanism;

a worm wheel that is rotatable and comprising teeth configured to engage with the spiral worm;

a worm wheel rotational shaft that is rotatable in response to rotation of the worm wheel;

a pinion gear that is disposed on the worm wheel rotational shaft coaxially with the worm wheel and rotatable in response to the rotation of the worm wheel; and a rack gear that is coupled to the pinion gear comprising teeth configured to engage with teeth of the pinion gear, the rack gear linearly movable in response to the rotation of the pinion gear and movable to an opening position or a closing position of the switch by being coupled to a movable contactor of the switch.

5. The actuator system of claim 4, wherein the movable contactor of the switch comprises:

a conductive rod comprising a long hole portion to limit a linear moving distance of the movable contactor and configured to allow the worm wheel rotational shaft to be inserted, the conductive rod formed of an electrically conductive material, wherein the pinion gear and the rack gear are installed within the conductive rod.

6. The actuator system of claim 1, wherein the selective power transfer mechanism further comprises:

a gear unit comprising a main gear axially supported by the output shaft of the actuator motor to be rotatable in the same direction in response to rotation of the output shaft;

a plurality of following gears rotatably coupled to the main gear and comprising teeth configured to engage with teeth of the main gear, the plurality of following gears corresponding to the plurality of switches and each comprising a plurality of power transfer pins configured to transfer the rotational force; and a plurality of rotational shafts correspondingly coupled to the plurality of clutch assemblies and correspondingly rotatable with the plurality of clutch assemblies, the plurality of rotational shafts connected to the corresponding plurality of link members to transfer the rotational force;

wherein:

each of the plurality of clutch assemblies has a first position connected to the power transfer pins to receive the rotational force from the power transfer pins and a second position separated from the power transfer pins;

the cam is further configured to move the clutch assembly of the plurality of clutch assemblies to the first position or the second position according to a position contacting each of the curved surfaces of the cam groove portion; and the cam motor is configured to rotate the cam by a predetermined rotational angle to drive one of the plurality of clutch assemblies connected to the cam to the first position or the second position.

7. The actuator system of claim 6, wherein the plurality of clutch assemblies are arranged to surround the main gear in a radial form based on an axial direction of the main gear.

8. The actuator system of claim 6, wherein each of the clutch assemblies comprises:

a cam connecting member configured to be inserted into the cam groove portion of the cam to be movable back and forth along the cam groove portion of the cam;

a clutch plate member comprising pin connection hole portions configured to allow the power transfer pins to be inserted or removed through the pin connection hole portions;

a spring disposed between the clutch plate member and the cam connecting member and configured to bias the clutch plate member toward the power transfer pins by applying elastic pressure to the clutch plate member when the cam connecting member moves toward the clutch plate member, and further configured to stop applying the elastic pressure to the clutch plate member when the cam connecting member moves away from the clutch plate member; and a connection pin configured to be inserted through the clutch plate member and the rotational shaft to couple the clutch plate member and the rotational shaft to each other.

9. The actuator system of claim 8, wherein the cam connecting member comprises a guide rod that extends in one direction to guide a back and forth linear motion, wherein the actuator system further comprises a support plate having a through hole portion configured to allow passage of the guide rod.

10. A common actuator system capable of switching a plurality of switches of a switchgear, the actuator system comprising:

a single actuator motor configured to provide a rotational force for opening or closing the plurality of switches and comprising an output shaft;

a plurality of flexible shafts corresponding to the plurality of switches and rotatably connected to the actuator motor to transfer the rotational force of the actuator motor;

a selective power transfer mechanism disposed between the actuator motor and the plurality of flexible shafts to operably connect the actuator motor to a flexible shaft of the plurality of flexible shafts corresponding to one of the plurality of switches in a selective manner;

a rotational-linear force conversion mechanism configured to convert the rotational force from the actuator motor into a linear force for opening or closing the plurality of switches and to transfer the converted linear force to the plurality of switches; and a gear unit comprising a main gear axially coupled to the output shaft of the actuator motor to be rotatable in the same direction in response to a clockwise rotation or a counter-clockwise rotation of the output shaft;

a plurality of following gears rotatably coupled to the main gear and comprising teeth configured to engage with teeth of the main gear, the plurality of following gears corresponding to the plurality of switches and each comprising a plurality of power transfer pins corresponding to the plurality of following gears and configured to transfer the rotational force.

11. The actuator system of claim 10, wherein the selective power transfer mechanism comprises:

a plurality of clutches corresponding to the plurality of switches and having a first position coupled to the power transfer pins to receive the rotational force from the power transfer pins and a second position separated from the power transfer pins;

a cam comprising a cam groove portion configured to be commonly coupled with the plurality of clutch assemblies, the cam groove portion formed by channel walls facing each other and comprising cam surfaces with a varying curvature, wherein the cam is configured to drive one of the plurality of clutches to the first position or the second position according to a position of each of the cam surfaces of the cam groove portion;

a cam motor configured to rotate the cam by a predetermined rotational angle to drive one of the plurality of clutches connected to the cam to the first position or the second position; and a plurality of rotational shafts coupled to the corresponding plurality of clutches and rotated together, wherein the plurality of rotational shafts are connected to the corresponding plurality of flexible shafts.

12. The actuator system of claim 10, wherein the rotational-linear power transfer mechanism comprises:

a spiral worm that is rotatable by the rotational force from the selective power transfer mechanism;

a worm wheel that is rotatable and comprising teeth configured to engage with the spiral worm;

a worm wheel rotational shaft that is rotatable in response to rotation of the worm wheel;

a pinion gear that is disposed on the worm wheel rotational shaft coaxially with the worm wheel and rotatable in response to the rotation of the worm wheel; and a rack gear that is coupled to the pinion gear and comprising teeth configured to engage with teeth of the pinion gear, the rack gear linearly movable in response to the rotation of the pinion gear and movable to an opening position or a closing position of the switch by being coupled to a movable contactor of the switch.

* * * * *